US006840513B1

(12) United States Patent
Rabindran

(10) Patent No.: US 6,840,513 B1
(45) Date of Patent: Jan. 11, 2005

(54) MAIL TRAY LOADER FOR INSERTERS

(76) Inventor: K. George Rabindran, 4022 W. Lake Estates Dr., Davie, FL (US) 33328-3065

( * ) Notice: Subject to any disclaimer, the term of this patent is extended or adjusted under 35 U.S.C. 154(b) by 263 days.

(21) Appl. No.: 10/286,036

(22) Filed: Nov. 1, 2002

(51) Int. Cl.[7] ..... B65H 29/18

(52) U.S. Cl. ..... 271/216; 271/217; 271/218; 271/215; 414/790.8; 414/789.9

(58) Field of Search ..... 271/207, 213, 271/214, 215, 216, 217, 218; 414/789.9, 790.7, 790.4, 790.8

(56) References Cited

U.S. PATENT DOCUMENTS

| | | | | |
|---|---|---|---|---|
| 1,284,781 A | | 11/1918 | Rogers | |
| 1,548,350 A | | 8/1925 | Charland | |
| 3,822,793 A | | 7/1974 | Stobb | |
| 3,865,365 A | | 2/1975 | Hardin et al. | |
| 4,051,957 A | * | 10/1977 | Parups | 414/791.1 |
| 4,273,491 A | | 6/1981 | Roux | |
| 4,518,160 A | * | 5/1985 | Lambrechts et al. | 271/214 |
| 4,750,315 A | | 6/1988 | Wadell | |
| 4,750,729 A | * | 6/1988 | Kanoto et al. | 271/162 |
| 4,805,890 A | * | 2/1989 | Martin | 271/203 |
| 5,009,053 A | | 4/1991 | Langenbeck et al. | |
| 5,135,352 A | * | 8/1992 | Scata et al. | 414/798.8 |
| 5,233,814 A | | 8/1993 | Bergerioux et al. | |
| 5,346,206 A | * | 9/1994 | Steinhart | 271/305 |
| 5,347,790 A | * | 9/1994 | Romanenko et al. | 53/443 |
| 5,347,791 A | | 9/1994 | Ginzl et al. | |
| 6,601,847 B2 | * | 8/2003 | Hendrickson et al. | 271/302 |

* cited by examiner

*Primary Examiner*—Patrick Mackey
(74) *Attorney, Agent, or Firm*—Howard B. Rockman; Barnes & Thornburg LLP

(57) ABSTRACT

The invention is directed to an automatic mail tray loading device that is adapted to receive envelopes from an inserting machine or from other mail-processing systems and place them in mail trays. The device has a two-stage envelope buffer, which buffers the envelopes into a shingled array before depositing them into the mail tray. The first stage buffers the envelopes during purging of the second stage and the second stage buffers the mail during a tray change. The mail trays are held on a tray conveyor, at an inclination that ensures proper loading of the tray and reliable transfer of envelopes from the tray. The tray conveyor incrementally moves the envelope tray downward until the tray is full of envelopes. A new, empty tray is then moved into position and the filled tray is moved laterally to the tray offload station. The system comprises an envelope conveyor, a tray conveyor, a lateral tray transfer mechanism and an auxiliary buffer. The envelope conveyor receives the envelopes from the inserter and buffers them in a shingled stream before discharging them into the envelope tray. The tray conveyor positions the envelope tray to receive the envelopes as they are discharged from the envelope conveyor. The tray lateral transfer mechanism advances the filled tray laterally to the offload station. The auxiliary buffer is located at the upstream end of the envelope conveyor and functions as the auxiliary buffer to buffer envelopes arriving from the inserter during purging of the envelope conveyor prior to a tray change.

19 Claims, 4 Drawing Sheets

MAIL TRAY LOADER FOR INSERTERS

BACKGROUND OF THE INVENTION

The present invention relates to mail tray loading devices used for automatically loading mail into mail trays. The mail tray loader is designed to eliminate the need for manual intervention during the tray loading process. The mail tray loader is also designed to reduce the cost and complexity found in present tray loading machinery. In a typical inserting machine installation, the envelopes exiting the inserting machine (inserter) are transferred from the inserter onto a low-speed conveyor on which the envelopes accumulate in a shingled stream. Transfer of mail from this conveyor to the mail tray is usually accomplished manually. This tends to stifle productivity, particularly in high-volume operations. Although some automatic traying machines exist, they are relatively complicated and expensive. The present invention replaces the traditional output conveyor and offers a compact and cost-effective means for loading the mail into trays automatically.

SUMMARY OF THE INVENTION

The disclosed automatic mail tray loading device is adapted to receive envelopes from an inserting machine or from other mail-processing systems and place them in mail trays. The device has a two-stage envelope buffer, which buffers the envelopes into a shingled array before depositing them into the mail tray. The first stage buffers the envelopes during purging of the second stage and the second stage buffers the mail during a tray change. The mail trays are held on a tray conveyor, at an inclination that ensures proper loading of the tray. The tray conveyor incrementally moves the envelope tray downward until the tray is full of envelopes. A new, empty tray is then moved into position and the filled tray is moved laterally to the tray offload station. The system consists of four main functional components: an envelope conveyor, a tray conveyor, a lateral tray transfer mechanism and an auxiliary buffer. The envelope conveyor receives the envelopes from the inserter and buffers them in a shingled stream before discharging them into the envelope tray. The tray conveyor positions the envelope tray to receive the envelopes as they are discharged from the envelope conveyor. The tray lateral transfer mechanism advances the filled tray laterally to the offload station. The auxiliary buffer is located at the upstream end of the envelope conveyor and functions as the auxiliary buffer to buffer envelopes arriving from the inserter during purging of the envelope tray prior to a tray change. This arrangement provides for an efficient and economical tray loading device and can accommodate the output from high speed inserters.

DETAILED DESCRIPTION OF THE PREFERRED EMBODIMENT

Figure 1:
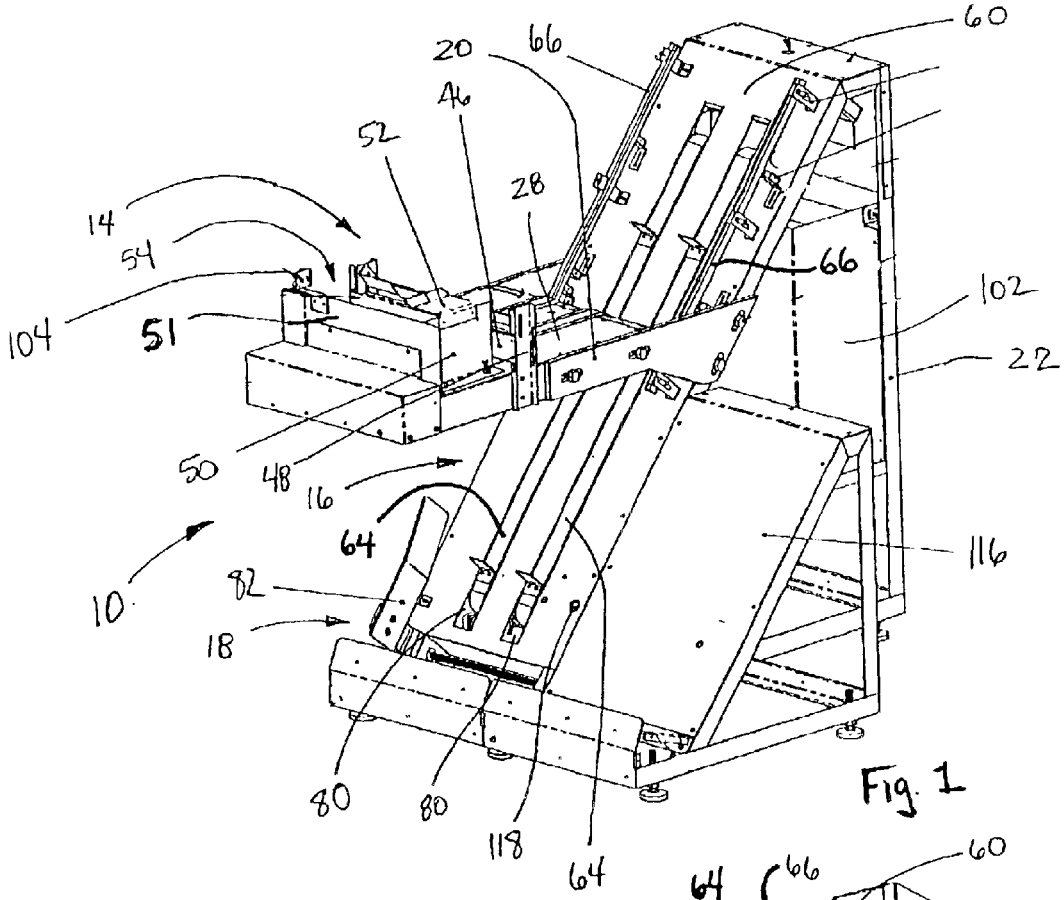
FIG. 1 is a perspective view illustrating the top, front and right side of the mail tray loader device.

For the purpose of promoting an understanding of the principles of the invention, reference will be made to the embodiments illustrated in the drawings. Specific language will also be used to describe the same. It will, nevertheless, be understood that no limitation of the scope of the invention is thereby intended, such alterations and further modifications in the illustrated device, and such further applications of the principles of the invention illustrated herein being contemplated as would normally occur to one skilled in the art to which the invention relates.

The embodiment shown in FIG. 1 is directed to a mail tray loading device 10 for association with mail inserter machines. Typically, the mail tray loading device 10 is positioned downstream from the mail inserter machine and either is connected to the mail inserter machine or positioned adjacent thereto.

The mail tray loading device 10, as shown in FIG. 1, comprises a two-stage envelope conveyor assembly 14, a tray conveyor assembly 16 and a lateral tray transfer assembly 18.

Figure 4:
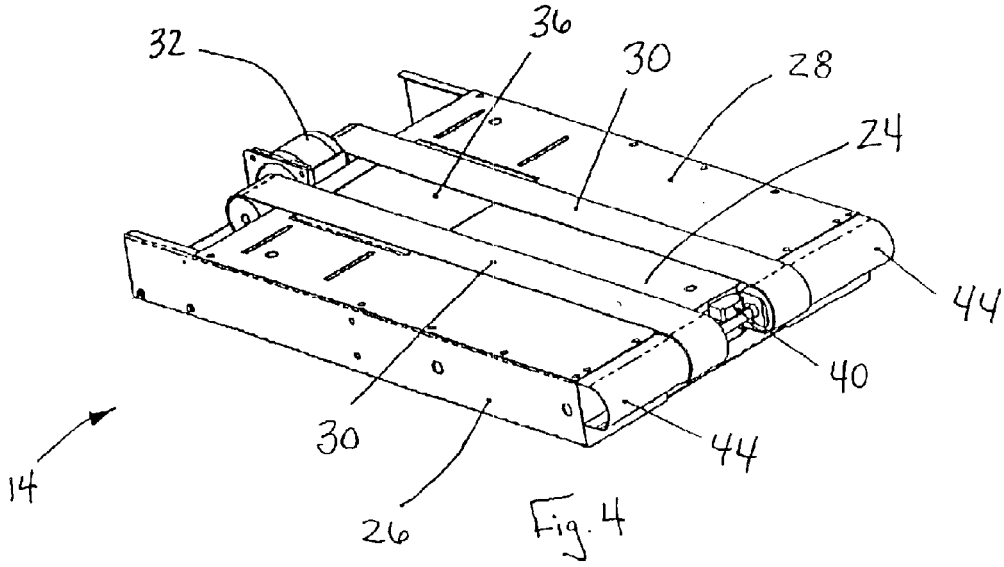
FIG. 4 is perspective view illustrating the top, rear and right side of the envelope conveyor.
Figure 5:
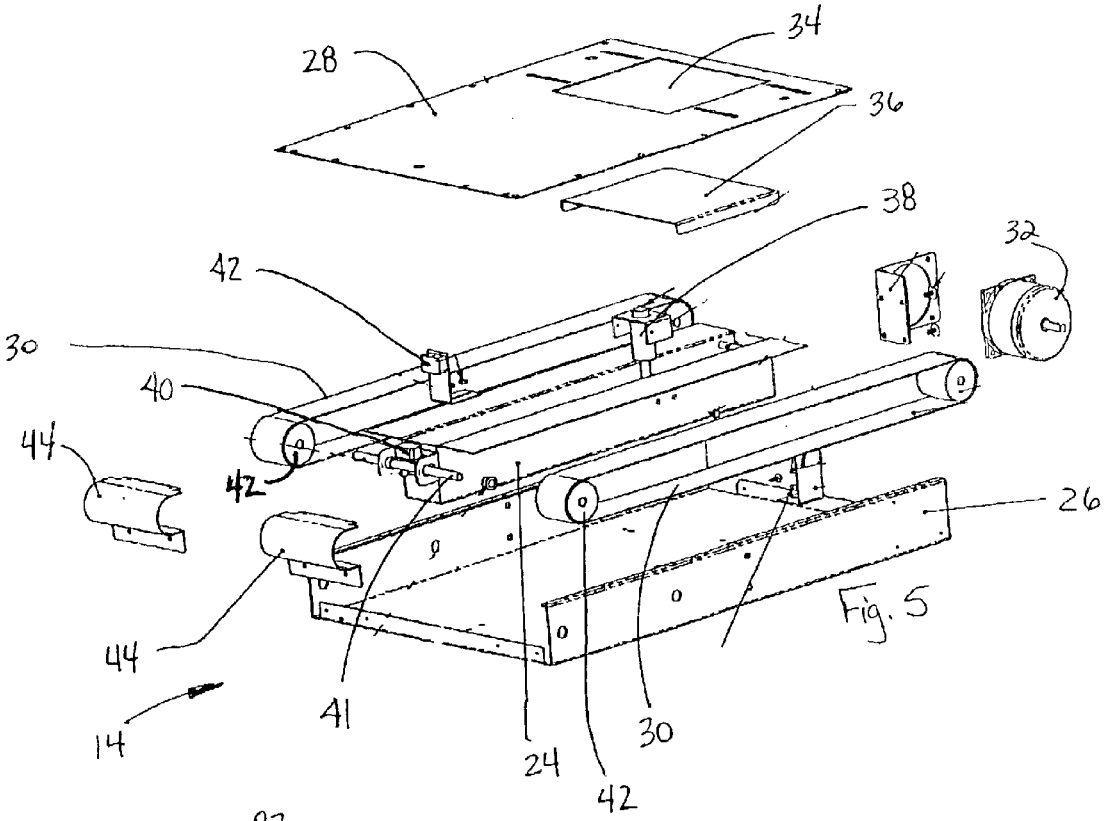
FIG. 5 is an exploded view of the envelope conveyor.
Figure 8:
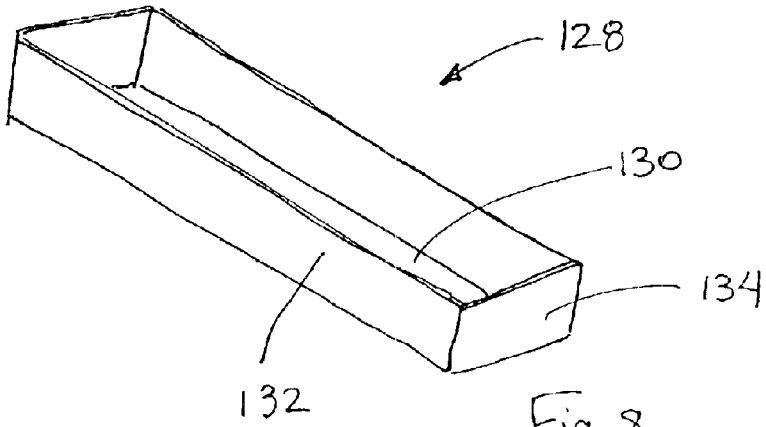
FIG. 8 is a perspective view of a mail tray.

The envelope conveyor assembly 14 receives envelopes from the inserter, and buffers the envelopes in a shingled array before discharging them into an envelope tray 128, as shown in FIG. 8. The envelope conveyor assembly 14 is comprised of a pair of conveyor support arms 20 that attach the envelope conveyor assembly 14 to a frame 22. The envelope conveyor assembly 14 also includes a main frame 24, a support pan 26 and a top plate 28, as shown in FIGS. 4 and 5. The support pan 26 of the envelope conveyor assembly 14 contains the main frame 24, first and second envelope conveyor belts 30, and a conveyor belt drive motor 32. The top plate 28 is connected to the top surface of the support pan 26 and is adapted to provide a support surface for the envelopes as the envelopes are advanced or held on conveyor belts 30. The top plate 28 includes a purge panel opening 34 (FIG. 5) adapted to receive a purge panel 36. The purge panel 36 is adapted to elevate the envelopes above the top plate 28 during a tray change cycle.

Referring to FIGS. 1,4 and 5, the main frame 24 of the envelope conveyor assembly 14 is positioned within the tray frame 22 and includes a purge panel solenoid 38 and an envelope level sensor 40 adapted to sense the level of the envelopes stacked in the envelope tray on the tray conveyor assembly 16. The main frame 24 also includes a conveyor pulley shaft 41 that is adapted to allow for the attachment of a pair of pulleys 42 that retain the conveyor belts 30. Also included on the envelope conveyor assembly 14 is a pair of outer roller covers 44 (FIG. 4) that aid in the transition of the envelopes as they are advanced from the envelope conveyor assembly 14 to the envelope tray 128.

Figure 2:
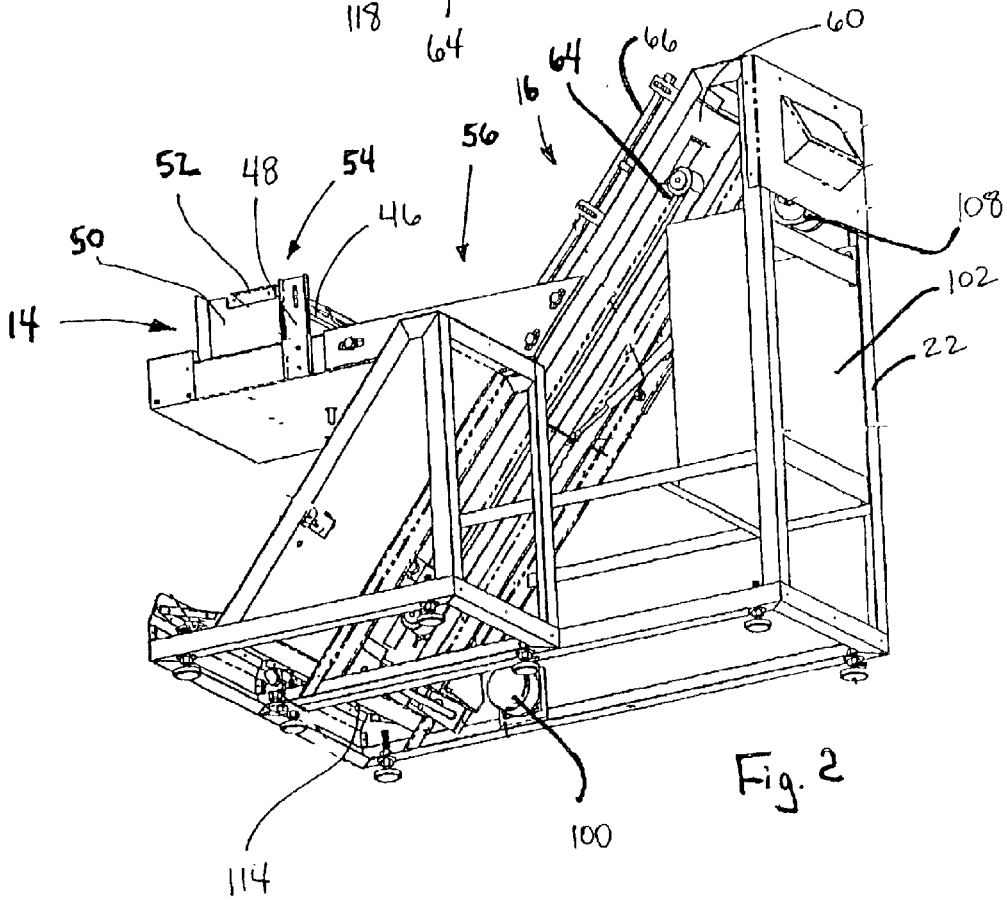
FIG. 2 is a perspective view illustrating the bottom, back and right side of the mail tray loader device.
Figure 3:
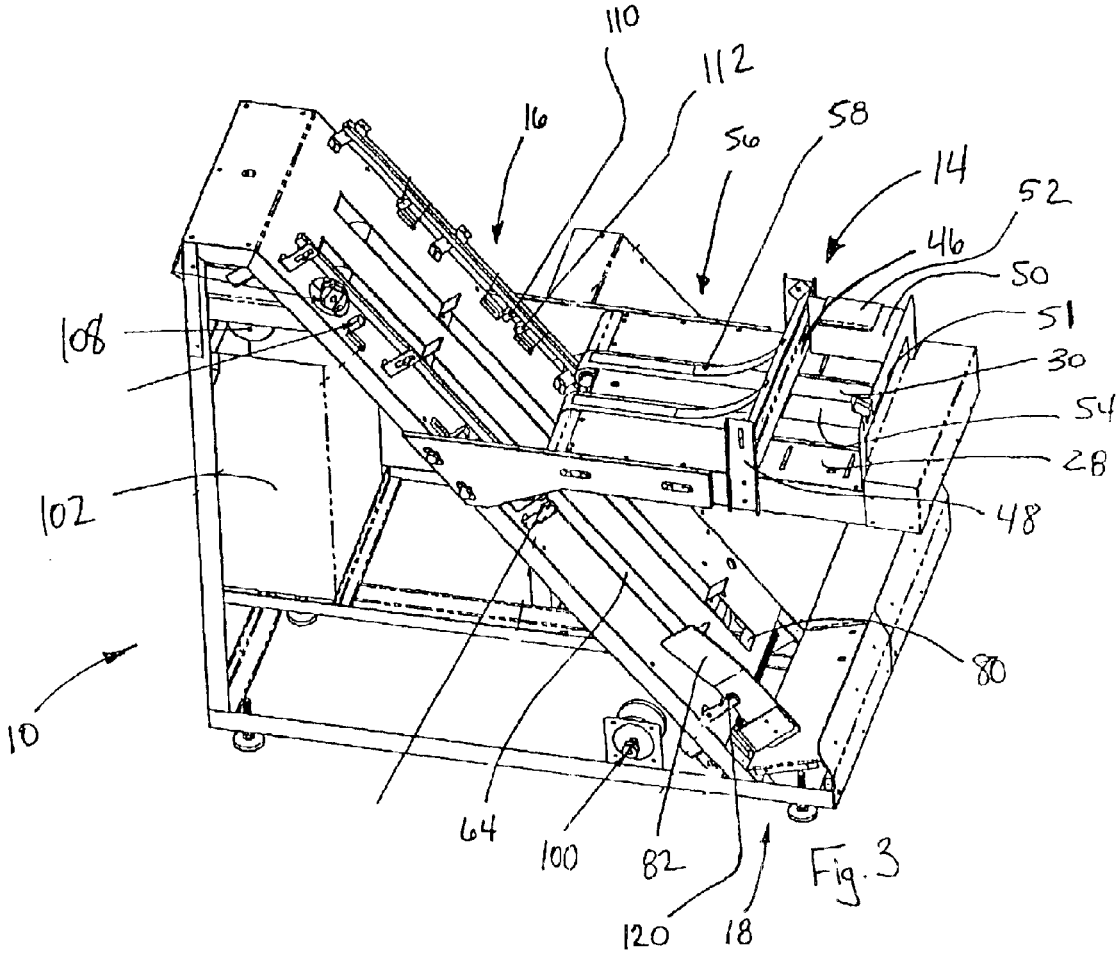
FIG. 3 is a perspective view illustrating the top, front and left side of the mail tray loader device.

The envelope conveyor assembly 14, as shown in FIGS. 1–3, further comprises an adjustable stop plate 46 that is positioned perpendicular to the top plate 28. The stop plate 46 includes a gap beneath the stop plate 46 that allows the envelopes to flow as an overlapping shingled array as they pass beneath the plate 46. The stop plate 46 is adjustably attached to the sides of the envelope conveyor assembly 14 by use of a pair of upwardly extending support brackets 48. The stop plate 46 can be adjusted to accommodate the passage of various thicknesses of envelopes through the gap.

The envelope conveyor assembly 14 also includes a back guide 50, a side guide 51 and an envelope deflector 52. The stop plate 46, the back guide 50 and the envelope deflector 52 comprise the first stage buffer area 54. As the envelopes exit the inserter machine, the leading edges of the envelopes contact the back guide 50 and drop onto top plate 28 and conveyor belts 30 to form a horizontal stack. As the envelopes stack in the first stage buffer area 54, the conveyor belts 30 pull the lowest envelopes in the stack beneath the stop plate 46 into a second stage buffer area 56. Pressure straps 58, as shown in FIG. 3, are mounted to the stop plate 46 and aid in maintaining the shingling of the envelopes in the second stage buffer area 56.

Figure 7:
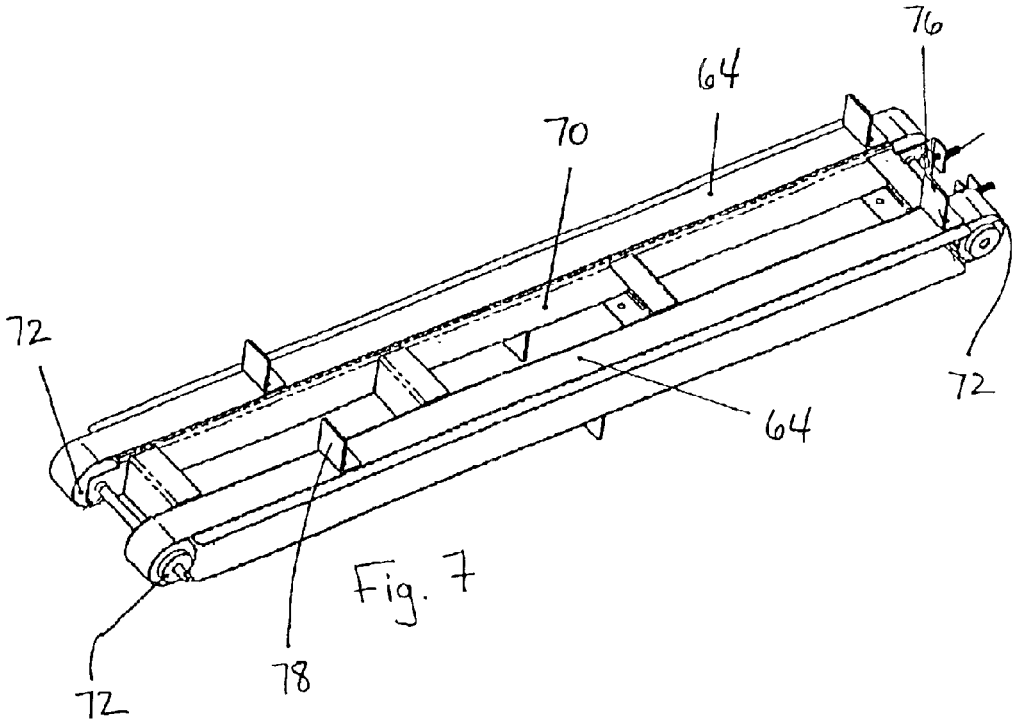
FIG. 7 is a perspective view of the tray conveyor assembly.

The tray conveyer assembly 16, as shown in FIGS. 1–3, is comprised of an inclined tray support surface 60 that is connected to the rigid frame 22. The frame 22 supports the tray conveyor assembly 16, the envelope conveyor assembly 14 and the lateral tray transfer assembly 18. The tray support surface 60 is comprised of a pair of tray conveyor belts 64 and a pair of guide rails 66 for maintaining the orientation of the tray 128. The tray conveyor belts 64, as shown in FIG. 7, are mounted to a tray conveyor frame assembly 70. The tray conveyor frame assembly 70 includes a pair of ribbed tray conveyor timing pulleys 72 located at both ends. The tray conveyor belts 64 are also ribbed to remain timed with respect to each other and are powered by a tray conveyor motor 108, as shown in FIG. 2. The tray conveyor pulleys 70 are mounted in pairs on a set of shafts 74. The tray conveyor frame assembly 70 also includes a belt tensioner 76 to alleviate slack in the tray conveyor belts 64. The tray conveyor belts 64 also include a plurality of spaced apart support brackets 78 that are adapted to support the tray 128 in an inclined position on the tray conveyor belts 64. The guide rails 66 are positioned outboard to the tray conveyor belts 64 and extend along the path of travel of the tray 128. The guide rails 66 are aligned to ensure that the tray 128 does not become skewed from the desired path of travel. Orientation of the tray 128 is important to ensure that proper loading takes place. As the tray 128 reaches the end of travel on the tray conveyor belts 64, the support brackets 78 pass through two openings 80 in the tray support surface 60, which causes the tray 128 to drop down into the lateral tray transfer assembly 18, as shown in FIGS. 1 and 3.

Figure 6:
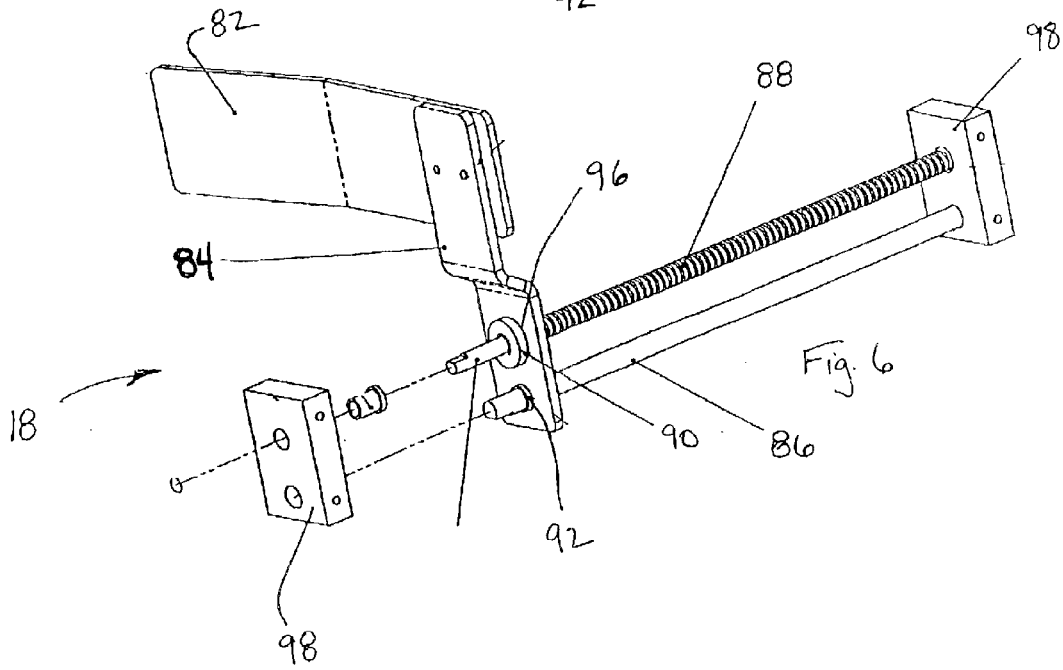
FIG. 6 is a perspective view of the lateral tray transfer assembly.

The lateral tray transfer assembly 18, as shown in FIG. 6, is comprised of a lateral transfer arm 82, an arm support 84, a guide rod 86, a lead screw 88 and a lead nut 90. The lateral transfer arm 82 is positioned adjacent to the tray support surface 60 and is connected to the arm support 84 by fasteners. The arm support 84 includes an aperture 92 that houses a bushing 94 adapted to slide along the guide rod 86. The arm support 84 also includes a second aperture 96 that is adapted to accept the lead nut 90. The guide rod 86 and lead screw 88 are supported at their respective ends by a pair of support blocks 98. The lateral transfer arm 82 is adapted to move across the path of the tray support surface 60 to laterally displace the tray 128 to clear the tray conveyor assembly area. The lead screw 88 is driven by an electric motor 100, which rotates and causes the arm support 84 to travel across the guide rod 86 and lead screw 88 moving the tray 128. When the arm support 84 has completed its travel, the electric motor 100 is reversed and the support arm 84 and lateral transfer arm 82 are returned to the rest position.

When the mail tray loading device 10 is operational, the conveyor belts 30 of the envelope conveyor assembly 16 are run at a low speed. The first stage buffer area 54 is ready to accept envelopes from the inserter machine. A processor 102 for the mail tray loading device 10 transmits a ready signal to the host inserter machine. As each envelope is discharged from the inserter, it is detected by an envelope sensor 104 that is attached to the side guide 51 in the first stage buffer area 54 before the envelope lands upon the conveyor belts 30. The first stage buffer area 54 is dimensioned to be approximately the size of the envelopes so that when the envelopes from the inserter enter, they form a uniform horizontal stack. The slow moving conveyor belts 30 continually grab and pull the lowest envelopes in the stack beneath the stop plate 46 and orient the envelopes in a shingled array as the envelopes move toward the second stage buffer area 56 and ultimately into the envelope tray 128.

The continuing motion of the conveyor belts 30 causes the envelopes to be discharged into the envelope tray 128 as shown in FIG. 8, which is positioned on the tray conveyor assembly 18. The tray 128 is a rectangular container having a closed bottom 130; an open top and four side walls 132. The tray 128 is positioned on the tray conveyor assembly 16 and the leading wall 134 of the tray 128 rests upon the support brackets 78. As the stack of envelopes in the envelope tray 128 accumulate, the top of the envelope stack is detected by the envelope level sensor 40, which sends a signal to the processor 102. The processor in turn, energizes the tray conveyor motor 108 to move the tray conveyor belts 64 downward to expose the empty portion of the tray 128. The tray conveyor belts 64 continue to move the tray 128 downward until the tray 128 is nearly full, as signaled by a tray full sensor 110. The tray full sensors 110 detect the trail edge of the tray 128. The tray full sensor 110 is continually tripped during the presence of a tray 128.

Once the trailing edge of the tray 128 passes the tray full sensors 110 the signal is no longer tripped and a signal is sent to the processor 102. Upon receiving a signal from the tray full sensor 110, the processor 102 initiates a tray change cycle. The tray change cycle consists of activating the purge panel solenoid 38, purging or emptying the envelope conveyor belts 30, and advancing a new (empty) tray 128 into position to receive a subsequent batch of envelopes from the envelope conveyor assembly 14. The activation of the purge panel solenoid 38 elevates the purge panel 36. The elevation of the purge panel 36 elevates the stack of envelopes in the first stage buffer area 54. The elevated position of the envelopes prevents them from passing beneath the stop plate 46, allowing the envelopes in the second stage buffer area 56 to be fully evacuated from the envelope conveyor assembly 14. Upon activation of the purge panel solenoid 38, the processor also increases the speed of the envelope conveyor belts 30 for a duration long enough to completely purge the second stage buffer area 56 of envelopes.

After the high speed operation of the envelope conveyor belts 30 has ended, the conveyor belts 30 resume their original travel speed. Upon the envelope conveyor belts 30 returning to their normal speed, the purge panel solenoid 38 is deactivated and the tray conveyor 64 is motorized to move a new (empty) tray 128 downward until a new tray sensor 112 detects the lead edge of the new tray 128. The deactivation of the purge panel solenoid 38 allows the conveyor belts 30 to restart the flow of envelopes down the envelope conveyor assembly 14 in a shingled array. Also, the downward movement of the tray conveyor 64 causes the full tray 128 to drop down into the lateral tray transfer assembly. Upon detection of the lead edge 134 of the new tray 128, the processor 102 de-energizes the conveyor motor 108 to halt the movement of the tray conveyor 64. Shingled envelopes that have resumed traveling the length of the envelope conveyor assembly 14 begin to enter the new tray 128. Upon detection of the top of the envelope stack by the envelope level sensor 140, the processor energizes the tray conveyor 64 to move the new tray 128 downward allowing additional envelopes to enter the tray 128.

The drop of the full tray 128 from the tray conveyor 64 onto the lateral tray transfer assembly 18 is detected by a filled tray exit sensor 114. Upon detection of the full tray 128 by the filled tray exit sensor 114, the processor 102 energizes the electric motor 100, which turns the lead screw 88. The rotation of the lead screw 88 pulls the lateral transfer arm 82 and arm support 84 across the guide rod 86, moving the full tray 128 to an offload station 116, as shown in FIG. 1. The tray 128 is driven sideways onto the offload station 116 until it is detected by the filled tray clear sensor 118. Upon detection of the filled tray 128 on the off-load station 116, the processor 102 reverses the electric motor 100 to return the lateral transfer arm 82 to its original position. The lateral transfer arm 82 is detected by lateral transfer arm home sensor 120, as shown in FIG. 3 which indicates that the lateral transfer arm 82 has returned to its original position. This completes one tray filling cycle, including lateral transfer.

In the simplest implementation of the mail tray loading device 10, placing the empty trays on the tray conveyor 64 and removing the filled trays from the offload station 116 will be manual operations. In applications where the host inserting machine discharges envelopes at a higher rate of speed, the placement and removal of the trays can be automated to maintain higher productivity by implementing additional hardware. An envelope conveyor exit sensor (not shown), an empty tray buffer sensor (not shown) and a full tray buffer sensor (not shown) are utilized to detect abnormal operating conditions. Upon abnormal activation of any of these sensors, the processor 102 halts the operation of the mail tray loading device 10 and sends a not ready signal to the host inserter machine and alerts an operator either audibly or visually to take corrective action.

The tray change cycle can also be initiated manually by pressing a manual tray change button, or by the host inserter machine sending a tray change command to the processor 102. The inserter machine may require a tray change to segregate envelope types or envelopes having different zip codes. Under normal operating conditions, it will be necessary to initiate a manual tray change at the end of an envelope run. In the case where a tray change command is received from the host inserter machine, the tray change cycle itself will be initiated by the processor after a preset number of envelopes are received from the inserter subsequent to receiving the tray change command. The specific preset number of envelopes will depend upon the particular inserter configuration.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A tray loading apparatus for loading an associated tray, the tray having a bottom wall and sidewalls defining an open top, one of the side walls being a leading wall, the tray being configured for receiving therein a plurality of stacked articles, said apparatus being adapted to receive the tray and load the tray with the articles, said apparatus comprising:

a frame;

an inclined tray support surface supported by said frame, said tray support surface adapted to support the tray and allow downward angular movement of the tray;

an inclined tray conveyor having a path of travel parallel to said tray support surface and adapted to receive the tray with the bottom wall thereon;

an article receiving buffer having an article intake end and an article discharge end, said article intake end adapted to receive a plurality of articles and allow horizontal stacking of the articles;

a stop plate positioned between said article intake end and said article discharge end, said stop plate oriented to create a gap beneath the stop plate to allow for the passage of a predetermined quantity of the articles;

an article receiving conveyor adapted to move the articles from said article intake end, beneath said stop plate to said article discharge end, said stop plate allowing the articles passing beneath to flow in a shingled pattern;

said tray conveyor adapted to move the tray incrementally downward, allowing the articles being discharged from said article receiving buffer to form a stack within the tray.

2. The tray loading apparatus of claim 1, further comprising a buffer plate positioned within said article receiving end and adapted to move the articles to an elevated position during a tray substitution cycle, preventing the articles from passing beneath said stop plate and returning the articles within said article receiving end to a non-elevated position to allow the articles to resume passage beneath said buffer plate.

3. The tray loading apparatus of claim 1, further including a lateral drive mechanism adapted to move the tray laterally with respect to said tray support surface upon release of the tray from said tray conveyor.

4. The tray loading apparatus of claim 3, further including a filled tray exit sensor adapted to activate said lateral drive mechanism when a filled tray is detected.

5. The tray loading apparatus of claim 1, wherein said tray conveyor includes at least one tray support bracket, extending outwardly from said tray conveyor and adapted to support the leading wall of the tray.

6. The tray loading apparatus of claim 1, further including an article positioning sensor adapted to advance the tray conveyor incrementally downward when the topmost article of the articles stacked in the tray is detected.

7. The tray loading apparatus of claim 1, wherein said tray support surface includes a pair of guide rails adapted to maintain the lateral orientation of the tray along the length of the tray support surface.

8. The tray loading apparatus of claim 1, further including a tray position sensor adapted to detect a trailing edge of the tray, said detection of the trailing edge of the tray by said tray position sensor initiating said tray substitution cycle.

9. The tray loading apparatus of claim 1, wherein said stop plate is adjustable to allow for the passage of articles of varying thicknesses beneath said stop plate.

10. The tray loading apparatus of claim 1, wherein said article receiving conveyor moves at a first speed during a tray fill cycle and at a second speed during said tray substitution cycle.

11. A method of loading a mail tray, the tray having a bottom wall and sidewalls defining an open top, one of the side walls being a leading wall, the tray being configured for receiving therein a plurality of stacked articles, such method comprising the steps of:

moving the tray incrementally down at an angle inclined to vertical;

detecting the leading wall of the tray and maintaining the position of the tray;

advancing the articles in a shingled array toward the open top of the mail tray;

discharging the articles into the tray, said articles forming a stack within the tray;

detecting the top most article in the tray and moving the tray incrementally downward;

detecting the trailing edge of the tray to start the initiation of a tray substitution cycle; and displacing the tray in a lateral direction.

12. The method of loading a mail tray of claim 11, including the additional step of elevating the articles prior to the step of advancing the articles to halt the discharge of the articles into the tray during said tray substitution cycle.

13. The method of loading a mail tray of claim 11 including the additional step of accelerating the advancement of the articles during said tray substitution cycle.

14. An apparatus for transferring and storing a plurality of flat objects, each object having a plurality of edges, into a container open on one face, closed on an opposite face, and having a plurality of additional faces extending between the opposite and open faces to define sides, the flat objects being stacked substantially perpendicular to the opposite face and against one of the sides defining a stacking surface, said apparatus adapted to receive the container and load the container with the objects, said apparatus comprising:

an inclined container support surface supported by a frame, said container support surface adapted to support the container and allow linear movement of the container with respect to said container support surface;

a conveyor adapted to receive the container with the opposite face thereon, said conveyor adapted to incrementally move the container linearly along said container support surface;

means for sensing the position of the container along said inclined container support surface;

an object receiving buffer having an object receiving receptacle adapted to receive a plurality of the articles and allow horizontal stacking of the articles therein;

an object receiving conveyor adapted to move objects along said object receiving buffer; and means for orienting the objects moving along said object receiving buffer in a shingled pattern.

15. The apparatus of claim 14, further comprising means for retaining at least a part of the objects moving along said object receiving buffer during a tray change cycle.

16. The apparatus of claim 14, further including a lateral drive mechanism adapted to move the container laterally with respect to said container support surface upon release of the container from said conveyor.

17. The apparatus of claim 16, further including a filled container exit sensor adapted to activate said lateral drive mechanism when a filled container is detected.

18. The apparatus of claim 14, wherein said conveyor includes a container support bracket, extending outwardly from said conveyor and adapted to support the container.

19. The apparatus of claim 14, wherein said container support surface includes a pair of guide rails adapted to aid in maintaining the lateral orientation of the container along the length of the container support surface.

* * * * *